US008777364B2

(12) United States Patent
Carrobe et al.

(10) Patent No.: US 8,777,364 B2
(45) Date of Patent: Jul. 15, 2014

(54) SHORT CIRCUIT DETECTION IN AN INKJET PRINTHEAD

(75) Inventors: Miriam Llorens Carrobe, Barcelona (ES); Cesar Fernandez Espasa, San Diego, CA (US); Jose Miguel Rodriguez, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 819 days.

(21) Appl. No.: 12/847,376

(22) Filed: Jul. 30, 2010

(65) Prior Publication Data

US 2012/0025845 A1 Feb. 2, 2012

(51) Int. Cl.
*B41J 2/01* (2006.01)

(52) U.S. Cl.
USPC ..... 347/19; 347/5; 347/14

(58) Field of Classification Search
USPC ..... 347/5, 9, 14–15, 19
See application file for complete search history.

(56) References Cited

U.S. PATENT DOCUMENTS

| | | | | |
|---|---|---|---|---|
| 6,039,428 | A | 3/2000 | Juve | |
| 6,378,979 | B1 * | 4/2002 | Anderson | 347/19 |
| 6,893,108 | B2 | 5/2005 | Choi et al. | |
| 6,971,731 | B2 * | 12/2005 | Brenner et al. | 347/14 |
| 7,232,201 | B2 | 6/2007 | Inde et al. | |
| 7,517,042 | B2 | 4/2009 | Espasa et al. | |
| 7,571,973 | B2 | 8/2009 | Hasseler | |
| 7,695,089 | B2 | 4/2010 | Espasa et al. | |
| 2007/0046712 | A1 | 3/2007 | Espasa et al. | |
| 2009/0244152 | A1 * | 10/2009 | Ishizaki | 347/14 |

FOREIGN PATENT DOCUMENTS

EP 0771655 A2 7/1997

* cited by examiner

*Primary Examiner* — Lam S Nguyen

(57) ABSTRACT

A short detection apparatus, system and method detect short circuits in an inkjet printhead using a comparison of measured current consumption and an estimate of current consumption based on print data. The apparatus includes a current sensor to measure current consumed by the printhead to eject a droplet of ink, a current estimator to estimate a current consumption of the printhead due to print data provided to the printhead, and a comparator to compare the measured consumed current to the estimated consumed current. A short circuit in the printhead is indicated when the comparison exceeds a predetermined threshold.

20 Claims, 2 Drawing Sheets

SHORT CIRCUIT DETECTION IN AN INKJET PRINTHEAD

CROSS-REFERENCE TO RELATED APPLICATIONS

N/A

STATEMENT REGARDING FEDERALLY SPONSORED RESEARCH OR DEVELOPMENT

N/A

BACKGROUND

Inkjet printers generally employ one or more printheads, also referred to as pens, to deposit ink on a print medium. The deposited ink forms an image on the print medium, details of the image being controlled by print data. Generally, the formed image may contain one or both of graphic content (e.g., drawings, graphs, photographs, etc.) and text content (i.e., letters and words).

In particular, the print data instructs the printhead when to deposit the ink, often in the form of small droplets, as a location or position of the printhead moves relative to the print medium. In various inkjet printer configurations, one or more of several methods that eject or expel ink from a nozzle or nozzles of the printhead may provide ink deposition by the printhead under the control of the print data. For example, in thermal inkjet printing, discrete droplets of ink are expelled from the printhead by passing a current through a resistive heating element in a chamber behind the nozzle. The current causes the resistive heating element to heat up and substantially vaporize a portion of the ink in direct contact with or in a vicinity of the resistive heating element. The vaporized ink forms an expanding bubble that, in turn, forces the ink in front of the bubble out of the chamber through the nozzle.

In some situations, residual ink may deposit one or both of on and around various electrical contacts of the printhead resulting in the formation of a short circuit. For example, the residual ink may deposit on electrodes that supply current to the resistive heating element. This residual ink deposition may short circuit the resistive heating element within the printhead, for example.

Attempts to address ink shorts and related short circuits in inkjet printer printheads have typically been focused on performing short circuit monitoring and detection when the inkjet printer is not printing. For example, an ink short detection algorithm may be run to detect ink shorts one or both of in between passes of the printhead across the print medium and in spaces between pages being printed. In many examples, a central processing unit (CPU) of the inkjet printer is responsible for running the ink short detection algorithm. For example, Espasa et al., U.S. Patent Application Publication No. 2007/0046712 A1 describe detecting ink shorts based on a page-by-page estimate of current consumption. According to Espasa et al., the ink short detection occurs after a page is printed but before printing begins for the next page.

However, in some situations there may be substantially no break in the printing (e.g., between passes or pages) that would allow time to perform short circuit detection. For example, in the case of commercial inkjet printers there may be no time between pages to perform the ink short detection algorithm. In other cases, the image may be substantially continuous and without page breaks for long periods of time. Moreover, in many cases the CPU is simply too busy controlling the printing process to also be responsible for monitoring and detecting potential printhead short circuits.

BRIEF DESCRIPTION OF THE DRAWINGS

The various features of embodiments may be more readily understood with reference to the following detailed description taken in conjunction with the accompanying drawings, where like reference numerals designate like structural elements, and in which.

Figure 1:
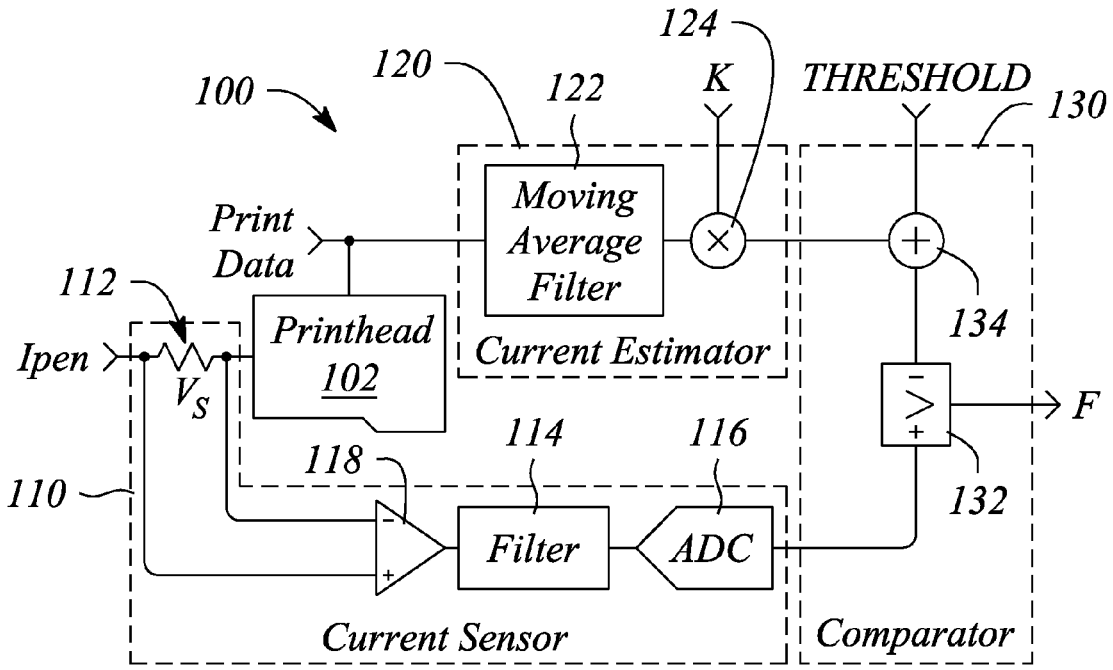
FIG. 1 illustrates a schematic diagram of a short circuit detection apparatus 100, according to an embodiment.

Certain embodiments have other features that are one of in addition to and in lieu of the features illustrated in the above-referenced figures. These and other features are detailed below with reference to the preceding drawings.

DETAILED DESCRIPTION

Embodiments may detect short circuits in printheads of inkjet printers. In particular, short circuits associated with the build up and bridging of residual ink within and around the printhead may be detected. As such, the short circuit detection may also be referred to as 'ink short' detection. For example, low resistance short circuits or 'shorts' may result from the build up of residual ink that produces ink dendrites. The ink dendrites may eventually bridge across electrical contacts of the printhead. The low resistance short circuits may adversely affect the performance of the printhead (e.g., by interfering with ink ejection) as well as pose a danger due to overheating of and excessive power consumption by the printhead during operation.

According to various examples below, the present short circuit detection is or may be performed in real time while the printhead is in operation. In some examples, the short circuit detection is implemented at the printhead using dedicated hardware. The use of dedicated hardware, collocated with the printhead for example, may reduce a computational load on a central processing unit (CPU) of an inkjet printer that employs the printhead. When dedicated hardware is employed, the short circuit detection may be referred to as 'hardware-assisted' short circuit detection.

According to various examples, short circuit detection is provided by comparing an estimate of current consumed by the printhead to actual current consumed by the printhead. The estimate is based on print data that is used to direct operation of the printhead. When the comparison indicates that more current is actually being consumed than should be according to the print data-based estimate, an ink short is indicated. A predetermined or programmable threshold may be employed in the comparison, in some examples.

For example, an ink short may be indicated when $$(K \cdot SMA_t + \text{THRESHOLD}) < Ipen$$

where $SMA_t$ is a moving average of the estimated current, K is a conversion factor, THRESHOLD is the predetermined threshold, and Ipen is the actual current consumed by the printhead. A value of the predetermined threshold THRESHOLD may be selected and adjusted so that a probability of false alarm or false short circuit detection is deemed acceptable. The conversion factor K and moving average $SMA_t$ are described further below.

Further herein, 'current' generally refers to and is defined as electric current. In general, current may be provided by a current source such as either a current generator or a voltage source/generator. The term 'short circuit' or 'short,' whether caused directly or indirectly by ink, is defined herein as an electrical short circuit or unintended low resistance condition that may develop between two or more electrical contacts during printhead operation (e.g., an ink short). By unintended it is meant that the two or more electrical contacts are normally intended to be either electrically isolated or at least not connected by the low resistance condition. In other words, the short circuit provides an electrical path for current between the electrodes that is or was not intended.

As used herein, the article 'a' is intended to have its ordinary meaning in the patent arts, namely 'one or more'. For example, 'a printhead' generally means one or more printheads and as such, 'the printhead' means 'the printhead(s)' herein. Also, any reference herein to 'top', 'bottom', 'upper', 'lower', 'up', 'down', 'left' or 'right' is not intended to be a limitation herein. Herein, the term 'about' when applied to a value generally means plus or minus 10% unless otherwise expressly specified. Moreover, examples herein are intended to be illustrative only and are presented for discussion purposes and not by way of limitation.

FIG. 1 illustrates a schematic diagram of a short circuit detection apparatus 100, according to an embodiment. The short circuit detection apparatus 100 facilitates detection of a short circuit or 'short' in an inkjet printhead 102. The detected short may occur during operation of the inkjet printhead, for example. In particular, the short may be caused by ink accumulating or otherwise bridging across a resistive heating element of the inkjet printhead 102, for example. Once the short is detected, a monitoring system (not illustrated) such as, but not limited to, a computer controller that controls the inkjet printhead 102 may take steps to disable or otherwise shutdown operation of the inkjet printhead 102.

In some examples, the inkjet printhead 102 is a printhead of a large, high speed, commercial printer with a plurality of inkjet printheads. The short circuit detection apparatus 100 may provide rapid detection of ink shorts in the inkjet printhead 102 as well as automatic identification of a specific inkjet printhead 102 of the plurality in which the short has occurred. Rapid detection and identification provides a safety feature for large, high speed, commercial printers as well as facilitating repair by pointing out which inkjet printhead needs attention.

As illustrated, the short circuit detection apparatus 100 comprises a current sensor 110. The current sensor 110 measures a current consumed by an inkjet printhead 102 to expel or eject a droplet of ink from the inkjet printhead 102. The ink droplet is ejected according to print data provided to the ink jet printhead 102. In particular, ejection of ink droplets by the inkjet printhead 102 is controlled by the print data forms an image being printed by a printer that employs the inkjet printhead 102. A timing of the ejection of ink droplets in cooperation with movement of one or both of the print medium and the inkjet printhead 102 under control of the print data is such that the ink droplets impact a print medium (e.g., paper, Mylar, etc.) in locations that are predetermined to form the image.

For example, the print data provided to the inkjet printhead 102 may comprise a sequence of digital signals (e.g., 1's and 0's) that instruct the inkjet printhead 102 whether or not to eject a droplet. A digital '1' may indicate a droplet is ejected while a digital '0' may indicate no droplet is ejected. In another example, the print data may comprise a voltage such that a voltage $V_1$ (e.g., 2.0 V) may indicate or cause a droplet to be ejected while another voltage $V_2$ (e.g., 0 V) may result in no droplet being ejected. A variety of other schemes may be used to affect the same result as described above including, but not limited to, an inverse of that described above, other combinations of voltages, and digital signals that have multiple bits representing whether or not to eject a droplet.

In some examples, the current sensor 110 measures the current consumed by the inkjet printhead 102 by producing an output that is proportional to consumed current. For example, the current sensor 110 may comprise a resistance in series with the printhead 102. Current flowing through the resistance to the inkjet printhead 102 produces a voltage that is proportional to the current and thus is proportional to the consumed current. Other examples of the current sensor 110 include, but are not limited to, current sensors that employ a gapped toroid or another coil (e.g., transformer) and current sensors based on the Hall effect. FIG. 1 illustrates an example of a current sensor 110 comprising a series resistor 112 (e.g., the resistance) that senses the current that flows into the inkjet printhead 102 and produces a voltage $V_S$ across the series resistor 112 that is proportional to the current consumed by the inkjet printhead 102. The series resistor 112 is sometimes referred to as a sense resistor.

In some examples (e.g., as illustrated in FIG. 1), the current sensor 110 may comprise a filter 114 to filter the quantity that is proportional to the current consumed by the inkjet printhead 102. The filter 114 may be a low pass filter, for example. In another example, the filter 114 may be a bandpass filter. An output of the filter 114 is the measured current. In some examples, the filter 114 may be implemented as an analog filter. For example, an analog lowpass filter may comprise a resistor or resistors and a capacitor or capacitors. In another example, the lowpass filter may be implemented using digital circuitry that mimics a transfer function of an analog lowpass filter. For discussion purposes, the filter 114 is illustrated as an analog lowpass filter comprising a series resistor R and a shunt capacitor C.

The lowpass filter 114 may be characterized by a resistor-capacitor (R-C) time constant, for example. The R-C time constant may characterize the filter 114 even if the filter 114 comprises more than just a resistor and a capacitor. In fact, the R-C time constant (which is related to an edge of a passband of the filter) may be used to characterize even those filters that are implemented digitally or that include inductors as well as resistors and capacitors. For example, the R-C time constant may be used to represent a half-power point or 3 dB cutoff frequency of a lowpass filter. Hence, the R-C time constant may be used to approximate certain higher order filters as a simple lowpass filter with a single resistor and capacitor in terms of an equivalent 3-dB cutoff frequency, for example.

In some examples (e.g., as illustrated in FIG. 1), the current sensor 110 further comprises an analog to digital converter (ADC) 116. The ADC 116 converts the measured current output of the filter 114 into a digital representation of the measured current. For example, the ADC 116 may convert the measured current output by the lowpass filter 114 into a digital representation of the lowpass filtered measured current. The ADC 116 may be a direct conversion or flash ADC, for example. In another example, the ADC 116 may be an integrating ADC. In other examples, another type of ADC converter including, but not limited to, a delta-encoded ADC, and a Sigma-Delta ADC, may be used to implement the ADC 116. A sampling rate of the ADC 116 is chosen to exceed a Nyquist rate of the measured current. For example, the sampling rate may be selected to be about two times a bandwidth (e.g., a 3-dB cutoff frequency) of the filter 114. A sample rate of the ADC 116 may be substantially faster than an inverse of the R-C time constant of the filter 114, for example.

In some examples (e.g., as illustrated in FIG. 1), the current sensor 110 further comprises a sense amplifier 118. The sense amplifier 118 amplifies the voltage $V_S$ across the series resistor 112. The amplification may increase a magnitude of the voltage $V_S$ to a level that is within a digitizing range of the ADC 116, for example. Various amplifiers, especially those used for sensing applications, may be used to implement the sense amplifier 118. For example, the sense amplifier 118 may comprise a differential amplifier.

As illustrated in FIG. 1, the short circuit detection apparatus 100 further comprises a current estimator 120. The current estimator 120 estimates a current consumption of the inkjet printhead 102. The current consumption estimation is based on print data and represents an estimate of the current that is consumed by the inkjet printhead 102 due to the print data that is received by the inkjet printhead 102.

In some examples, the current estimator 120 comprises a moving average filter 122. The moving average filter 122 may be configured to provide a moving average of a number of droplets per unit time based on the print data. An output of the moving average filter 122 is the estimated current.

In some examples, the moving average filter 122 implements a moving average ($SMA_t$) at a time t given by equation (1) as $$SMA_t = \frac{SMA_{t-1} \cdot (N-1) + p_M}{N} \tag{1}$$

where $p_M$ is a value of a data sample from the print data at the time t, $SMA_{t-1}$ is a previous moving average at time t−1, and N is a number of data samples that are included within a time window of the moving average filter. For example, the print data may be represented by a string of ones and zeros (e.g., {0, 1, 1, 0, 0, 1, 0, 1, 1}), a one instructing the inkjet printhead 102 to expel a droplet while a zero results in no droplet expulsion. Each of the ones and zeros in the string of print data corresponds to a time location t. As such, the data sample $p_M$ may take on a purely a binary value (i.e., $p_M \in \{0,1\}$), in some examples. For the example above and assuming that t=0 is the first element in the example string, the data sample for t=5 is $p_M=1$, while the data sample for t=4 (i.e., t−1) is $p_M=0$. In some examples, N may be chosen to substantially match the filter 114. For example, N may be chosen such that $\tau = t \cdot N$, where $t = R \cdot C$ is the R−C time constant of the filter 114.

In some examples, the current estimator 120 further comprises a multiplier 124. The multiplier 124 scales the output of the moving average filter 122 by a predetermined conversion factor K. The scaled moving average filter output is the estimated current. A value of the predetermined conversion factor K may be based on a particular ink type that is used in the inkjet printhead. For example, the value the predetermined conversion factor K may be selected to be high enough for a particular ink type to reduce or even minimize false alarms (i.e., false short circuit detections) by the short circuit detection apparatus 100.

Values of the predetermined conversion factor K may range between about 1 and about 10, for example. In some examples, the predetermined conversion factor K value may range between about 2.0 and about 6.0. In some particular examples, the predetermined conversion factor K value may range between about 3.5 and about 6.0 for black ink while the predetermined conversion factor K value may range between about 2.0 and about 4.0 for magenta inks, yellow inks and cyan inks. In other particular examples of black inks, the predetermined conversion factor K value may range between about 4.5 and about 5.5. In yet other particular examples, the predetermined conversion factor K value may range between about 3.5 and about 5.0 for fixers used to fix and protect inkjet ink that has been deposited on a print medium.

In some examples, elements of the current estimator 120 such as, but not limited to, the moving average filter 122 and the multiplier 124, may be implemented as a dedicated circuit that may be collocated with the inkjet printhead 102. The dedicated circuit may comprise a hardware-based implementation such as, but not limited to, an application specific integrated circuit (ASIC) or using discrete logic circuits. In other examples, the dedicated circuit may employ machine-readable instructions to implement the current estimator 120 (e.g., one or both of firmware and software). For example, the dedicated circuit may employ one or both of a field programmable gate array (FPGA) and a microcomputer that executes instructions stored in memory. However, while implemented to employ machine-readable instructions, the dedicated circuit still may be collocated with the inkjet printhead 102.

In other examples, the current estimator 120 is implemented in part or in whole as part of a controller of an inkjet printer that employs the inkjet printhead 102. For example, the current estimator 120 may be implemented as instructions of a computer program that may be executed by a processor (e.g., a central processing unit or CPU) of the inkjet printer. Implementing the current estimator 120 as a dedicated circuit means that the inkjet printer processor does not have to devote processor time to computing the moving average. Moreover, the short circuit detection apparatus 100 may be considered as being a hardware-assisted short circuit detection apparatus 100 when the dedicated circuit is employed, regardless of whether or not the implementation employs a hardware-based implementation or a firmware/software based implementation, for example.

As illustrated in FIG. 1, the short circuit detection apparatus 100 further comprises a comparator 130. The comparator 130 compares the measured current to the estimated current. A short circuit in the inkjet printhead 102 may be indicated when the comparison exceeds a predetermined threshold. The comparison indicating a short circuit may result in a short fault flag F being communicated to the inkjet printer (e.g., as an interrupt that is handled by the inkjet printer CPU) in some examples. For example, an output of the comparator (e.g., a logic high indicating a fault and a logic low indicating no fault) may serve as the fault flag F.

In some examples, the comparator 130 comprises a comparator block 132 and a summation block 134. The comparator block 132 is connected to receive an output of the summation block 134. The summation block 132 adds a value of the predetermined threshold to the estimated current produced by the current estimator 120. The comparator block 132 determines if the measured current is greater than the summation block 134 output. When the measured current is greater than the summation block 134 output, the comparator block 132 issues a fault flag F. For example, the comparator block 132 may set or establish a logic high on an output port when the comparator block 132 determines that the measured current exceeds the summation block 134 output. Alternatively, a logic low, a pulse or another logic transition on the output port may be used as the fault flag F. As with the current estimator 120, the comparator 130 may be implemented as a discrete circuit local to the inkjet printhead 102 to reduce a computational load on the CPU of the inkjet printer.

Figure 2:
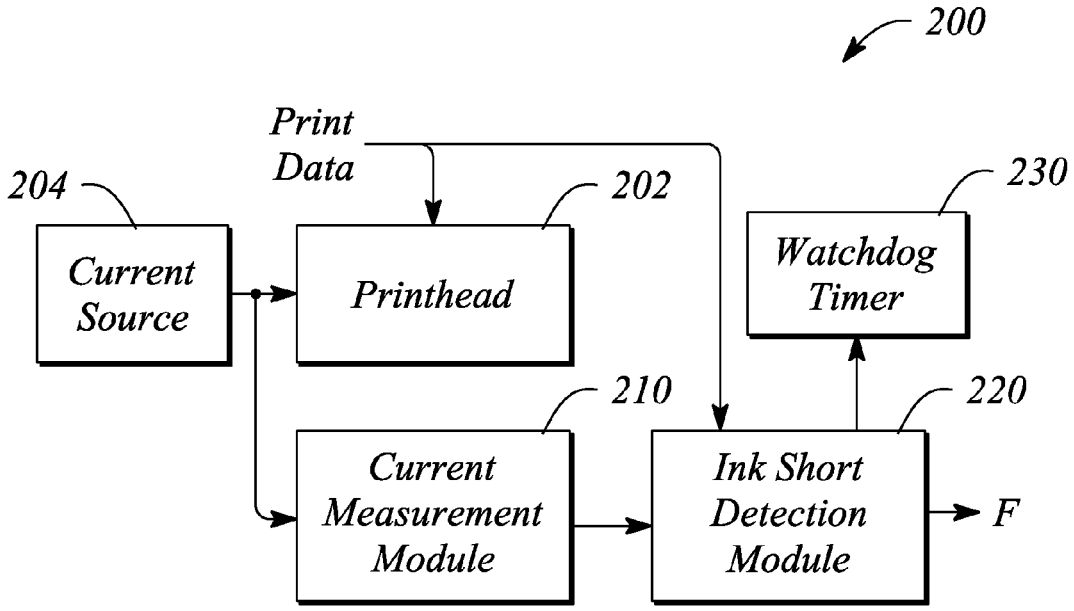
FIG. 2 illustrates a block diagram of an ink short detection system 200, according to an embodiment.

FIG. 2 illustrates a block diagram of an ink short detection system 200, according to an embodiment. The ink short detection system 200 may be a part of or incorporated into an inkjet printer, for example. In some examples, the inkjet printer may be a commercial inkjet press. For example, the ink short detection system 200 may be used in an inkjet press such as, but not limited to, the HP T300 Color Inkjet Web Press, manufactured by Hewlett-Packard Company, Houston, Tex.

As illustrated, the ink short detection system 200 comprises a printhead 202. The printhead 202 may be a printhead of the inkjet printer system, for example. The printhead 202 prints droplets of ink in response to print data provided to the printhead 202. Current consumption by the printhead 202 is proportional to a number of droplets printed per unit time. In particular, by definition the current consumption by the printhead 202 referenced here is a portion of the electric current consumed by the printhead 202 to expel droplets of ink during the printing process. The current may be consumed to heat a resistive heater used to expel ink from the printhead 202 according to the print data in a thermal inkjet printer, for example. The ink short detection system 200 may detect short circuit conditions that may occur in the printhead 202. Specifically, the ink short detection system 200 may detect short circuits that result from ink building up on and bridging across the resistive heater, for example. Similarly, the ink short detection system 200 may detect other, potentially dangerous or damaging shorts that might occur during operation of the printhead 202.

As illustrated, the ink short detection system 200 further comprises a current measurement module 210. The current measurement module 210 provides a measurement of the current consumption by the printhead 202. In some examples, the current measurement module 210 directly senses the current flowing into the printhead 202 in response to print data and then outputs the measurement representing current consumption. In other examples, the current measurement module 210 senses the current indirectly (e.g., by sensing a field produced by the current). In some examples, the current measurement module 210 is substantially similar to the current sensor 110, described above with respect to the short circuit detection apparatus 100.

In particular, according to some examples, the current measurement module 210 comprises a sense resistor. The sense resistor may be located between the printhead 202 and a current source 204. The example current measurement module 210 further comprises a lowpass filter. The lowpass filter filters a signal generated by current that flows through the sense resistor. The current that flows through the sense resistor is provided by the current source 204 and is current consumed by the printhead 202. For example, the generated signal may comprise a voltage that develops across the sense resistor due to the flowing current. The current measurement module 210 further comprises an analog-to-digital converter (ADC). The ADC converts an output of the lowpass filter into a digital representation. The digital representation produced by the ADC is the current consumption measurement, for example.

In some example, the current measurement module 210 further comprises a sense amplifier. The sense amplifier amplifies a voltage produced across the sense resistor by the current. The amplified voltage is the generated signal that is filtered by the lowpass filter, for example. The sense amplifier may comprise a differential amplifier having inputs connected across the sense resistor, for example.

As illustrated, the ink short detection system 200 further comprises an ink short detection module 220. The ink short detection module 220 compares the measurement of current consumption by the printhead 202 to an estimate of the current consumption. The estimate of the current consumption is generated from the print data. The ink short detection module 220 provides an ink short fault flag F that indicates detection of an ink short when a difference between the estimate of the current consumption and the current consumption measurement exceeds a predetermined threshold.

Specifically, the ink short detection module 220 receives the current consumption measurement from the current consumption module 210. The ink short detection module 220 further receives the print data and produces the current consumption estimate from the print data. The ink short detection module 220 still further compares the current consumption measurement to the current consumption estimate. In some example, the ink short fault flag F may be transmitted to a central processing unit (CPU) of the inkjet printer. In response to the ink short fault flag F, the CPU may then, for example, take actions to shutdown one or both of the printhead 210 and the inkjet printer itself. In some examples, the ink short detection module 220 is substantially similar to a combination of the current estimator 120 and the comparator 130 described above with respect to the short detection apparatus 100.

In some examples, the ink short detection module 220 comprises a moving average filter. The moving average filter produces from the print data a moving average of a number of droplets printed per unit time. For example, the moving average filter may implement equation (1) described above.

In some examples, the ink short detection module 220 further comprises a multiplier. The multiplier multiplies the moving average by a conversion factor to yield a scaled moving average that represents the estimate of the consumed current. The conversion factor may be the conversion factor K described above with respect to the short detection apparatus 100, for example.

In some examples, the ink short detection module 220 further comprises a summation block or summer. The summation block adds a value of the predetermined threshold to the estimate of the consumed current to produce a summation value. In some examples, the ink short detection module 220 further comprises a comparator. The comparator compares the summation value to the current consumption measurement. A result of the comparison by the comparator determines if the difference between the estimate of the current consumption and the current consumption measurement exceeds the predetermined threshold.

In some examples, the ink short detection system 200 further comprises a watchdog timer 230. The watchdog timer 230 initiates shutdown of the printhead 202 when no response to the ink short fault flag is received in a predetermined period of time after the ink short fault flag is provided. For example, the watchdog timer 230 may start counting when the ink short fault flag is transmitted to the inkjet printer CPU. If the CPU does not respond within the predetermined period, the watchdog timer 230 may issue a command that results in the shutdown of the printhead 202. The response may be one or both of a clearing of the ink short fault flag by the CPU and an action by the CPU that begins shut down of the printhead 202. In some examples, the watchdog timer 230 is implemented as part of the ink short detection module 220.

In some examples, one or more elements or modules of the ink short detection system 200 may be implemented local to the printhead 202. For example, the current measurement module 210 and the ink short detection module 220 may both be implemented as dedicated hardware that is local to and directly associated with the printhead 202. The use of dedicated hardware at the printhead 202 to provide ink short detection may free the inkjet printer (e.g., the CPU) from having to monitor printhead operation for ink shorts, for example. As such, in some implementations, the ink short detection system 200 represents hardware assisted ink short detection.

Figure 3:
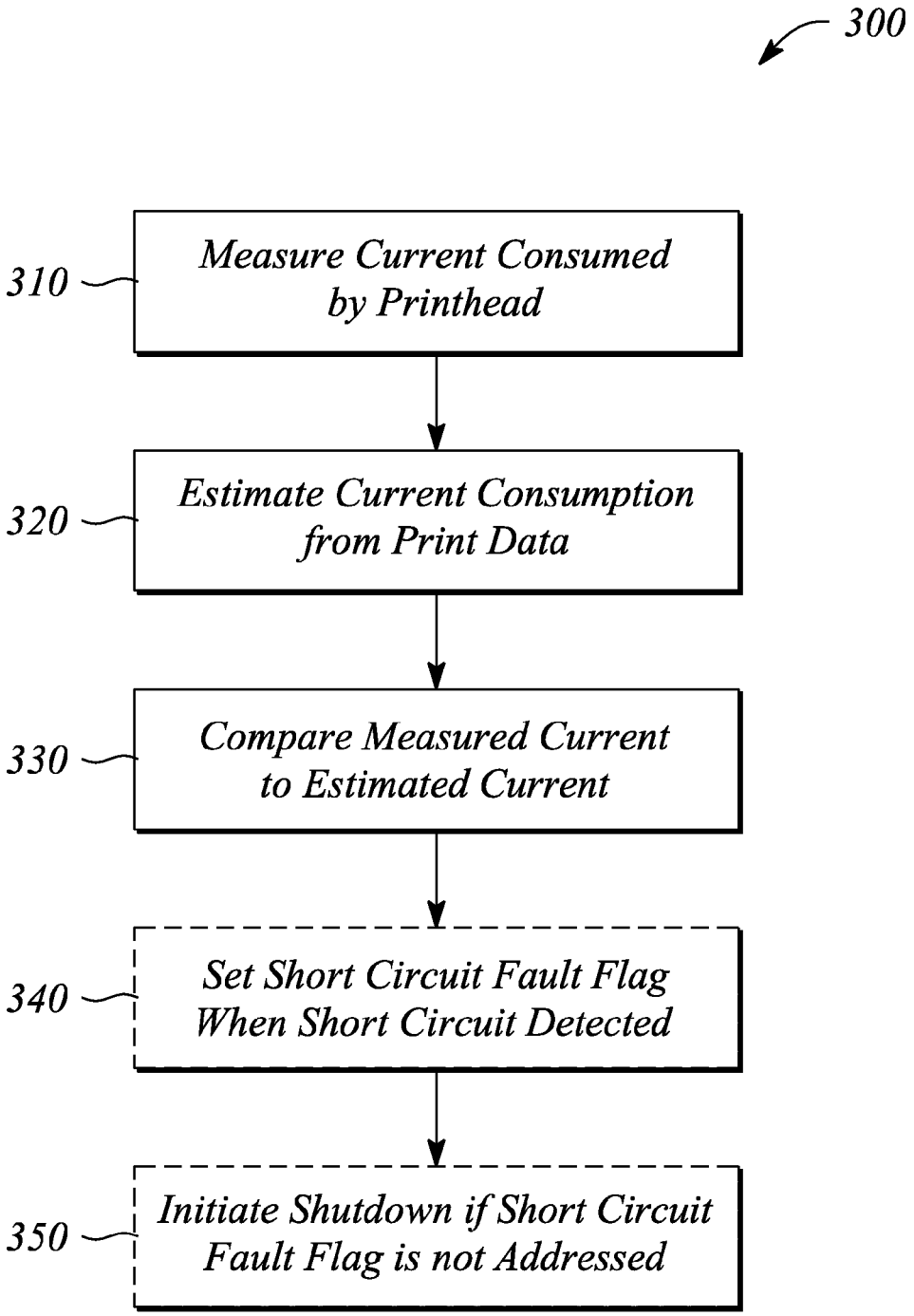
FIG. 3 illustrates a flow chart of a method 300 of short circuit detection operable with an inkjet printhead, according to an embodiment.

FIG. 3 illustrates a flow chart of a method 300 of short circuit detection operable with an inkjet printhead, according to an embodiment. The inkjet printhead may be part of an inkjet printer, for example. In some examples, the short circuit detected by the method 300 may be the result of ink building up on and bridging across a resistive heater element or an equivalent that is used to expel ink from the printhead. As such, the method 300 of short circuit detection may also be used to detect ink shorts, in some examples.

As illustrated, the method 300 of short circuit detection comprises measuring 310 a current consumed by the inkjet printhead. The current is consumed in response to print data received by the inkjet printhead. Measuring 310 a current produces a measured consumed current. For example, measuring 310 a current may be performed by one or both of the current sensor 110 and the current measurement module 210 described above with respect to the short detection apparatus 100 and the ink short detection system 200, respectively.

In particular, in some examples, measuring 310 the consumed current comprises producing a signal that is proportional to the current consumed by the inkjet printhead. In some examples, measuring 310 the consumed current further comprises filtering the signal using a lowpass filter. Filtering the signal produces the measured consumed current. For example, the signal produced may be a voltage developed across a sense resistor between a current source and the printhead. In some examples, the measured consumed current is further converted into a digital representation by an analog-to-digital converter (ADC). In other examples, the signal that is proportional to the consumed current is converted to a digital representation (e.g., using an ADC) and filtering the signal is performed on the digital representation using a digital filter to produce the measured consumed current.

As illustrated in FIG. 3, the method 300 of short circuit detection further comprises estimating 320 from the print data a current consumption of the inkjet printhead. Estimating 320 the current consumption is performed according to the print data. Estimating 320 the current consumption produces an estimated consumed current. Estimating 320 the current consumption may be performed by one or both of the current estimator 120 and an estimating portion of the ink short detection module 220, respectively, described above with respect to the short detection apparatus 100 and the ink short detection system 200.

In some examples, estimating 320 the current consumption comprises receiving the print data. The print data may be received by sampling a data path to the inkjet printhead, for example. In some examples, estimating 320 the current consumption further comprises producing a moving average of the print data. The moving average represents a moving average of a number of drops per unit time printed by the inkjet printhead according to the print data, in some examples. The moving average may be produced by a moving average filter, for example. In some examples, the moving average is given or described by equation (1) above. In some examples, estimating 320 further comprises scaling the moving average by a predetermined conversion factor K. The predetermined conversion factor K may be substantially similar to the predetermined conversion factor K described above with respect to the short detection apparatus 100, for example.

Further as illustrated in FIG. 3, the method 300 of short circuit detection further comprises comparing 330 the measured consumed current to the estimated consumed current. According to method 300, a short circuit is detected when the comparison indicates that the measured consumed current exceeds the estimated consumed current by an amount that is greater than a predetermined threshold.

In some examples (e.g., as illustrated), the method 300 further comprises setting 340 a short circuit fault flag when a short circuit is detected. For example, setting 340 may comprise establishing a logic level or providing a logic level change at an interrupt input to a CPU of the inkjet printer. The CPU may then take steps to shut down inkjet printhead or otherwise handle the detected short circuit (e.g., one or both of notify an operator and attempt to clear the short automatically). A comparator used in comparing 330 the measured consumed current to the estimated consumed current may be employed to set 340 the short circuit fault flag, for example.

In some examples (e.g., as illustrated), the method 300 further comprises initiating 350 a shutdown of the inkjet printhead if the short circuit fault flag is not addressed within a predetermined period of time. The short circuit fault flag may be addressed by the CPU clearing the short circuit fault flag, for example. Shutdown may be initiated 350 using a watchdog timer, for example. In another example, the short circuit fault flag is addressed de facto when the CPU initiates shutdown of the inkjet printhead. Both setting 340 a short circuit fault flag and initiating 350 a shutdown are illustrated in FIG. 3 using dashed lines to indicate that they may be present in some examples of the method 300 of short circuit detection.

Thus, there have been described examples of a short circuit detection apparatus, an ink short detection system and a method of short circuit detection that compare measured current consumption to an estimate of current consumption by a printhead to detect a short circuit in the printhead. It should be understood that the above-described embodiments and examples are merely illustrative of some of the many specific embodiments and examples that represent the principles recited in the claims. Clearly, those skilled in the art can readily devise numerous other arrangements without departing from the scope as defined by the following claims.

What is claimed is:

1. A short circuit detection apparatus comprising:

a current sensor to measure a current consumed by an inkjet printhead to eject a droplet of ink;

a current estimator to estimate a current consumption of the inkjet printhead due to print data provided to the inkjet printhead; and a comparator to compare the measured current to the estimated current, a short circuit in the inkjet printhead being indicated when the comparison exceeds a predetermined threshold, wherein the current estimator comprises a moving average filter to provide a moving average of a number of droplets per unit time based on the print data, an output of the moving average filter being the estimated current.

2. The short circuit detection apparatus of claim 1, wherein the current sensor comprises a lowpass filter to filter a quantity that is proportional to the current consumed by the inkjet printhead, an output of the lowpass filter being the measured current.

3. The short circuit detection apparatus of claim 2, wherein the current sensor further comprises a sense resistor connected in series between the inkjet printhead and a source of the current consumed by the inkjet printhead, the quantity that is proportional to the consumed current being a voltage across the sense resistor.

4. The short circuit detection apparatus of claim 2, wherein the current sensor further comprises an analog-to-digital converter (ADC) to convert the measured current output of the lowpass filter into a digital representation of the measured current.

5. The short circuit detection apparatus of claim 1, wherein the moving average filter implements a moving average ($SMA_t$) at a time t given by $$SMA_t = \frac{SMA_{t-1} \cdot (N-1) + p_M}{N}$$

where $p_M$ is a value of a data sample from the print data at the time t, $SMA_{t-1}$ is a previous moving average at time t−1, and N is a number of data samples that are included within a time window of the moving average filter.

6. The short circuit detection apparatus of claim 1, further comprising a multiplier to scale the output of the moving average filter by a predetermined conversion factor, the scaled moving average filter output being the estimated current, a value of the predetermined conversion factor being based on a particular ink type used in the inkjet printhead.

7. The short circuit detection apparatus of claim 1, wherein the comparator comprises:

a summation block to add a value of the predetermined threshold to the estimated current produced by the current estimator; and a comparator block to receive an output of the summation block and to determine if the measured current is greater than the summation block output, wherein the comparator block produces a fault flag if the measured current is greater than the summation block output.

8. The short circuit detection apparatus of claim 1, further comprising a watchdog timer to initiate a shutdown of the inkjet printhead when no response to an ink short indication is received in a predetermined period of time.

9. An ink short detection system in an inkjet printer comprising:

a printhead of the inkjet printer that prints droplets of ink in response to print data, a number of droplets printed per unit time being proportional to current consumption by the printhead; and an ink short detection module to compare a measurement of the current consumption to an estimate of the current consumption, the estimate being generated from the print data, the ink short detection module comprising a moving average filter to produce from the print data a moving average of the number of droplets printed per unit time, wherein the ink short detection module provides an ink short fault flag that indicates detection of an ink short when a difference between the estimate of the current consumption and the current consumption measurement exceeds a predetermined threshold.

10. The ink short detection system of claim 9, further comprising a current measurement module that comprises:

a sense resistor located between the printhead and a current source;

a lowpass filter to filter a signal generated by current that flows through the sense resistor, the current being provided by the current source and being current of the current consumption by the printhead; and an analog-to-digital converter (ADC) to convert an output of the lowpass filter into a digital representation, the digital representation being the current consumption measurement.

11. The ink short detection system of claim 10, wherein the current measurement module further comprises a sense amplifier to amplify a voltage produced across the sense resistor by the current, the amplified voltage being the generated signal that is filtered by the lowpass filter.

12. The ink short detection system of claim 9, wherein the ink short detection module further comprises:

a multiplier to multiply the produced moving average by a conversion factor to yield a scaled moving average that represents the estimate of the current consumption;

a summation block to add a value of the predetermined threshold to the estimate of the current consumption to produce a summation value; and a comparator to compare the summation value to the current consumption measurement, wherein the comparison determines if the difference between the estimate of the current consumption and the current consumption measurement exceeds the predetermined threshold.

13. The ink short detection system of claim 9, further comprising a watchdog timer to initiate a shutdown of the printhead when no response to the ink short fault flag is received in a predetermined period of time after the ink short fault flag is provided.

14. A method of short circuit detection, the method comprising:

measuring a current consumed by an inkjet printhead in response to print data received by the inkjet printhead to produce a measured consumed current;

estimating from the print data a current consumption of the inkjet printhead according to the print data to produce an estimated consumed current, wherein estimating the current consumption comprises:

receiving the print data; and producing a moving average of the print data using a moving average filter; and comparing the measured consumed current to the estimated consumed current, an ink short being detected when the comparison indicates that the measured consumed current exceeds the estimated consumed current by an amount that is greater than a predetermined threshold.

15. The method of short circuit detection of claim 14, wherein measuring a current consumed comprises:

producing a signal that is proportional to the current consumed; and filtering the signal using a lowpass filter, wherein filtering produces the measured consumed current.

16. The method of short circuit detection of claim 14, wherein the moving average represents a moving average of a number of drops per unit time printed by the inkjet printhead according to the print data.

17. The method of short circuit detection of claim 16, wherein the moving average of the print data is given by $$SMA_t = \frac{SMA_{t-1} \cdot (N-1) + p_M}{N}$$

where $SMA_t$ is the moving average at a time t, $p_M$ is a value of a data sample from the inkjet printhead print data at the time t, $SMA_{t-1}$ is a previous moving average at time t−1, and N is a number of data samples that are included within a time window of the moving average filter, wherein the data sample corresponds to a droplet that is printed by the inkjet printhead.

18. The method of short circuit detection of claim 16, wherein estimating from the print data a current consumption further comprises scaling the moving average by a predetermined conversion factor.

19. The method of short circuit detection of claim 14, further comprising:

setting a short circuit fault flag when a short circuit is detected; and initiating a shutdown of the inkjet printhead if the short circuit fault flag is not addressed within a predetermined period of time.

20. An ink short detection apparatus used in conjunction with an inkjet printer, the ink short detection apparatus comprising:

a current sensor to measure a current consumed by a printhead of the inkjet printer to eject a droplet of ink, the current sensor comprising a lowpass filter;

a current estimator to estimate a current consumption of the inkjet printhead due to print data of the inkjet printhead, the current estimator comprising a moving average filter to provide a scaled moving average of a number of droplets per unit time, the moving average being scaled by a predetermined conversion factor to yield the estimated current;

a comparator to compare the measured current to the estimated current, an ink short in the inkjet printhead being indicated when the comparison exceeds a predetermined threshold; and a watchdog timer to initiate a shutdown of the inkjet printhead when no response to the ink short indication is received in a predetermined period of time.

* * * * *